US012364316B1

(12) United States Patent
Pugachevskiy

(10) Patent No.: US 12,364,316 B1
(45) Date of Patent: Jul. 22, 2025

(54) TRANSFORMATIONAL ACCESSORY SYSTEM

(71) Applicant: Vadim Pugachevskiy, Marlboro, NJ (US)

(72) Inventor: Vadim Pugachevskiy, Marlboro, NJ (US)

( * ) Notice: Subject to any disclaimer, the term of this patent is extended or adjusted under 35 U.S.C. 154(b) by 0 days.

(21) Appl. No.: 18/597,559

(22) Filed: Mar. 6, 2024

(51) Int. Cl.
*A44C 9/00* (2006.01)

(52) U.S. Cl.
CPC ..... *A44C 9/0023* (2013.01)

(58) Field of Classification Search
CPC ..... A44C 9/0023; A44C 5/00; A44C 5/0084; A44C 5/0092; A44C 9/00; A44C 9/0007; A44C 9/0015; A44C 9/003
USPC ..... D11/12, 26
See application file for complete search history.

(56) References Cited

U.S. PATENT DOCUMENTS 236,806 A * 1/1881 Hammond ..... A44C 5/0092 D11/4
2,220,408 A * 11/1940 Kalina ..... A44C 9/0015 63/15.3
2,287,451 A * 6/1942 Reiter ..... A44C 9/003 D11/4
3,995,447 A * 12/1976 Levsunov ..... A44C 9/0053 63/15
5,483,808 A * 1/1996 Barbazza ..... A44C 9/003 63/15.4
2017/0035161 A1* 2/2017 Malo ..... A44C 9/003
2023/0346086 A1* 11/2023 Ostanin ..... A44C 17/02

FOREIGN PATENT DOCUMENTS

FR 577308 A * 2/1924

* cited by examiner

*Primary Examiner* — Jack W Lavinder
(74) *Attorney, Agent, or Firm* — Norris McLaughlin, PA

(57) ABSTRACT

An exemplary transformable accessory may comprise a first half structure having a first abutment surface, the first half structure being coupled to a slotted shank with a slot therein; a second half structure having a second abutment surface, the second half structure being coupled to a posted shank with a post extending therefrom, wherein the post of the posted shank is received within the slot of the slotted shank; and a configuration in which the first abutment surface and the second abutment surface are either in contact or radially separated from one another.

6 Claims, 13 Drawing Sheets

TRANSFORMATIONAL ACCESSORY SYSTEM

FIELD OF THE INVENTION

The present invention relates to accessories in the forms of rings, necklaces, bracelets, and the like, that have multi-various forms that are attainable through movement of their parts.

BACKGROUND

In typical jewelry, the user must choose one form with one type of design to the exclusion of others. Alternatively, a user can have multiple designs for their accessories, but will have to wear the accessories simultaneously.

Accessories to be worn are small in size and leave very little room for manipulation in a way that does not make the accessory large, unattractive, or otherwise difficult to manipulate. Thus, users tend to stay away from jewelry that involves a great deal of effort or is cumbersome to wear due to mechanical parts.

Most accessories with mechanical attachments that are worn, such as lockets, tend to keep the mechanical hinges away from the user to avoid unwanted repeated contact while the user and the accessory move with respect to one another during routine activities (e.g., walking, sitting, eating). Placing moving or mechanical joints in contact with the skin of a user is typically avoided to make the jewelry more pleasant to wear. Consequently, hinges other than those that rotate in a plane that is parallel to the user's skin are preferred because the axis of rotation is never targeted at the user's skin (e.g., chest, arms, ankles, wrists, or fingers).

SUMMARY

FINALIZE WHEN VADIM APPROVES

Figure 1A:
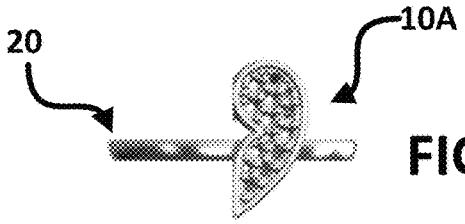
FIG. 1A illustrates a top view of an exemplary first transformational accessory component according to a first embodiment.
Figure 1B:
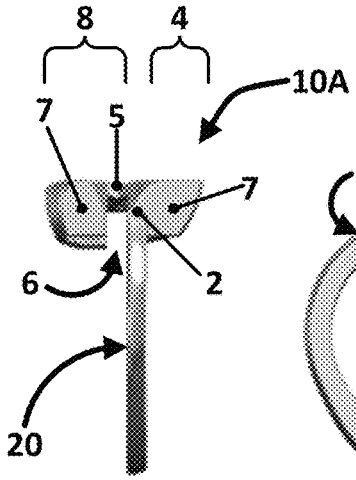
FIG. 1B illustrates a profile view of the external face of an exemplary first transformational accessory component according to a first embodiment.
Figure 1C:
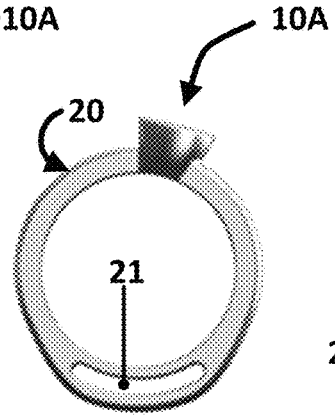
FIG. 1C illustrates a front view of an exemplary first transformational accessory component according to a first embodiment.
Figure 1D:
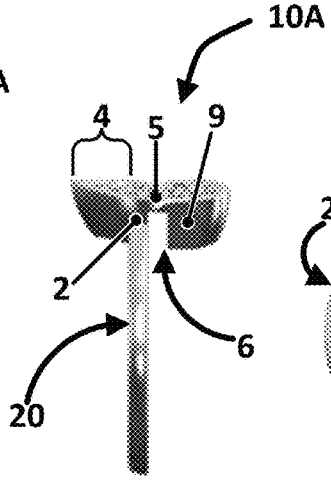
FIG. 1D illustrates a profile view of the external face of an exemplary first transformational accessory component according to a first embodiment.
Figure 1E:
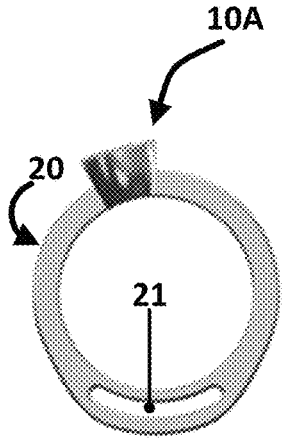
FIG. 1E illustrates a rear view of an exemplary first transformational accessory component according to a first embodiment.
Figure 1F:
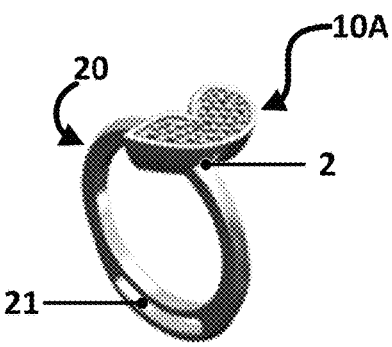
FIG. 1F illustrates an isometric view of the external face of an exemplary first transformational accessory component according to a first embodiment.
Figure 1G:
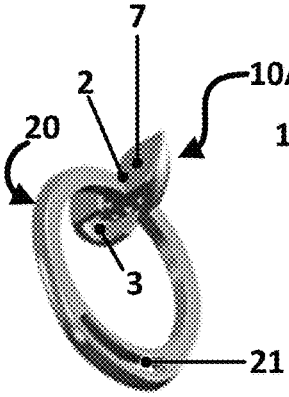
FIG. 1G illustrates an isometric view of the internal face of an exemplary first transformational accessory component according to a first embodiment.
Figure 1H:
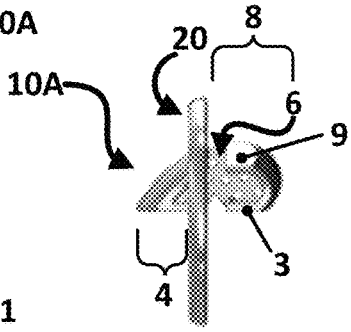
FIG. 1H illustrates a bottom view of an exemplary first transformational accessory component according to a first embodiment.
Figure 1I:
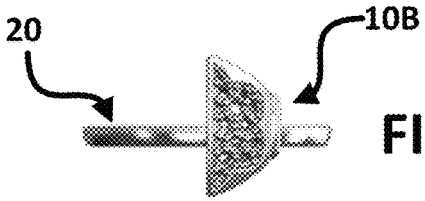
FIG. 1I illustrates a top view of an exemplary first transformational accessory component according to a second embodiment.
Figure 1J:
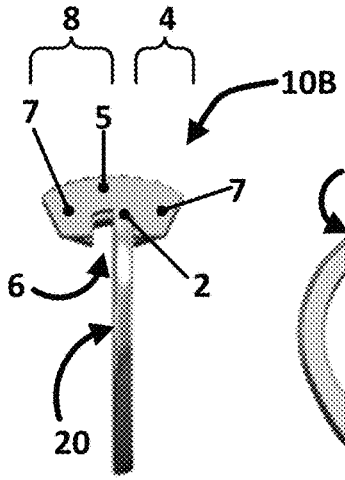
FIG. 1J illustrates a profile view of the external face of an exemplary first transformational accessory component according to a second embodiment.
Figure 1K:
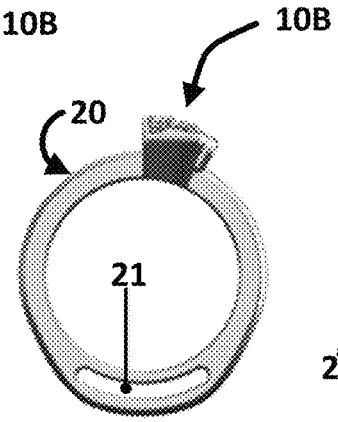
FIG. 1K illustrates a front view of an exemplary first transformational accessory component according to a second embodiment.
Figure 1L:
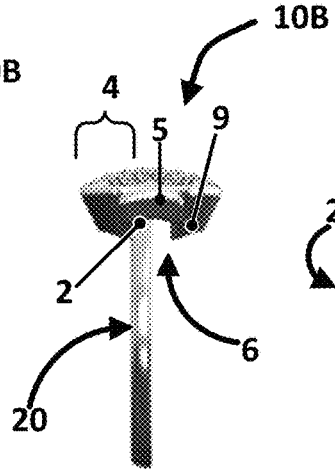
FIG. 1L illustrates a profile view of the external face of an exemplary first transformational accessory component according to a second embodiment.
Figure 1M:
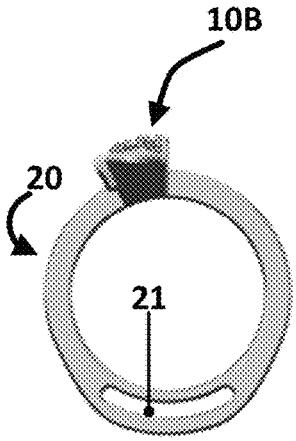
FIG. 1M illustrates a rear view of an exemplary first transformational accessory component according to a second embodiment.
Figure 1N:
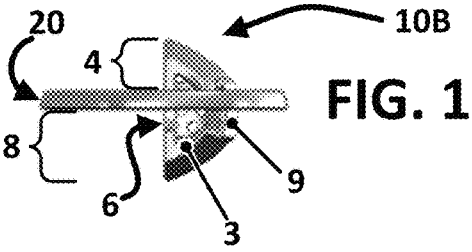
FIG. 1N illustrates an isometric view of the external face of an exemplary first transformational accessory component according to a second embodiment.
Figure 1O:
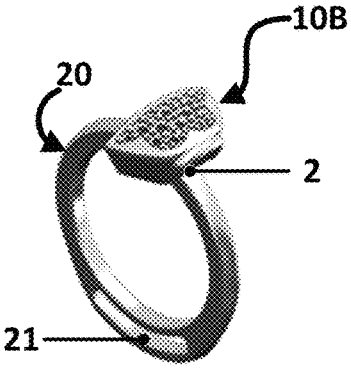
FIG. 1O illustrates an isometric view of the internal face of an exemplary first transformational accessory component according to a second embodiment.
Figure 1P:
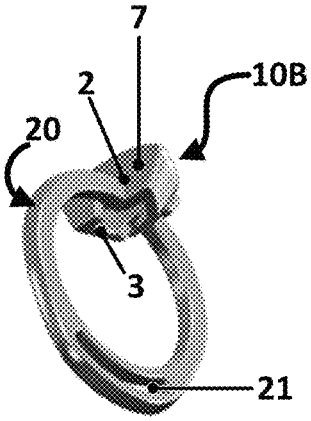
FIG. 1P illustrates a bottom view of an exemplary first transformational accessory component according to a second embodiment.
Figure 1Q:
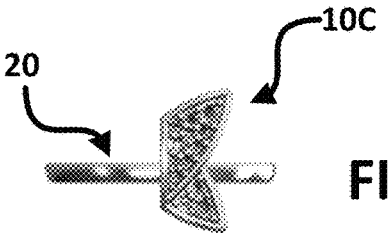
FIG. 1Q illustrates a top view of an exemplary first transformational accessory component according to a third embodiment.
Figure 1R:
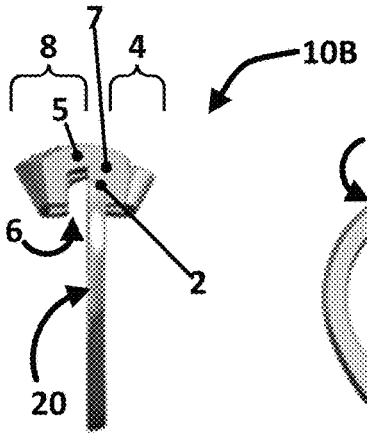
FIG. 1R illustrates a profile view of the external face of an exemplary first transformational accessory component according to a third embodiment.
Figure 1S:
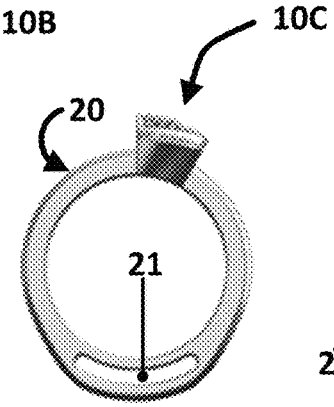
FIG. 1S illustrates a front view of an exemplary first transformational accessory component according to a third embodiment.
Figure 1T:
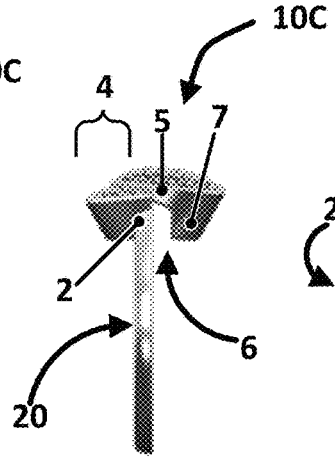
FIG. 1T illustrates a profile view of the external face of an exemplary first transformational accessory component according to a third embodiment.
Figure 1U:
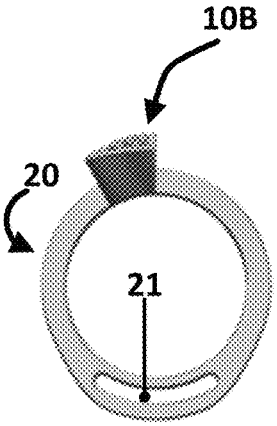
FIG. 1U illustrates a rear view of an exemplary first transformational accessory component according to a third embodiment.
Figure 1V:
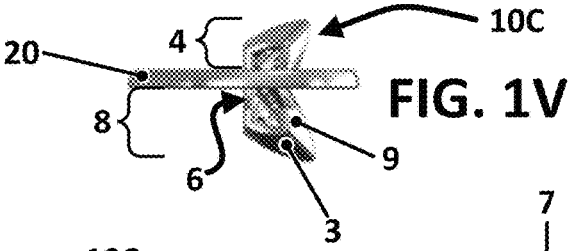
FIG. 1V illustrates an isometric view of the external face of an exemplary first transformational accessory component according to a third embodiment.
Figure 1W:
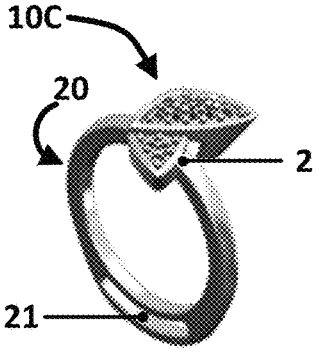
FIG. 1W illustrates an isometric view of the internal face of an exemplary first transformational accessory component according to a third embodiment.

In the drawings like characters of reference indicate corresponding parts in the different and interchangeable and interrelated figures. Parts and components of each figure may be substitutes for other components in other figures to achieve the various methods and embodiments disclosed herein. Methods and protocols disclosed in any embodiment may be run in any order so as to affect their disclosed goals and/or enable performance of the systems as described. Additionally, any one embodiment may utilize any method or protocol described and in any portions, sequences, and combinations thereof.

DETAILED DESCRIPTION

Figure 3A:
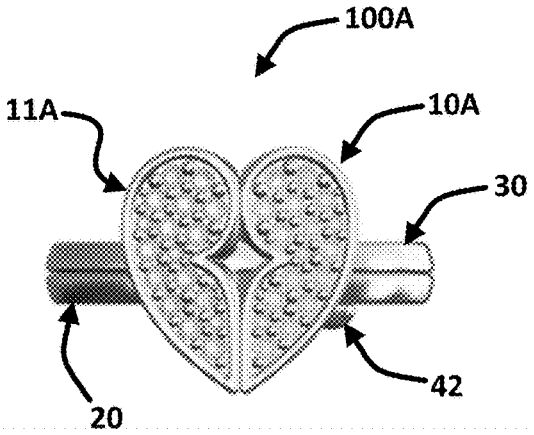
FIG. 3A illustrates a top view of an exemplary first transformational accessory combination according to a first embodiment.
Figure 3B:
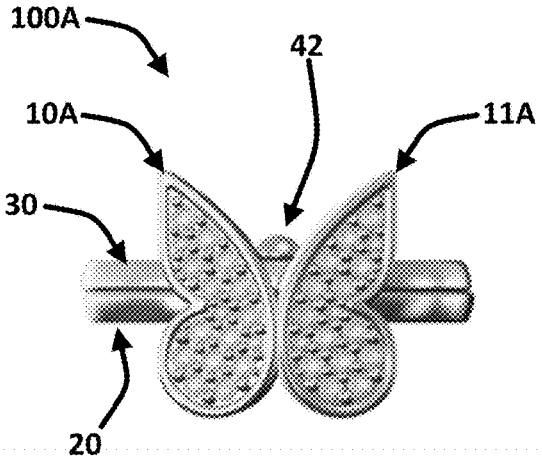
FIG. 3B illustrates a top view of an exemplary second transformational accessory combination according to a first embodiment.
Figure 3C:
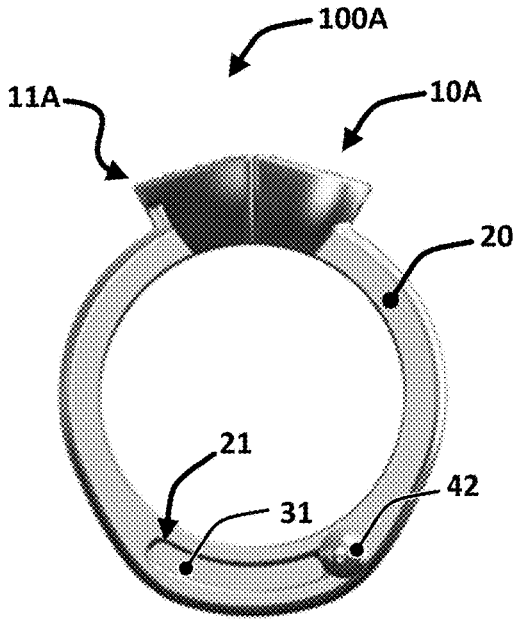
FIG. 3C illustrates a front view of an exemplary first transformational accessory combination according to a first embodiment.
Figure 3D:
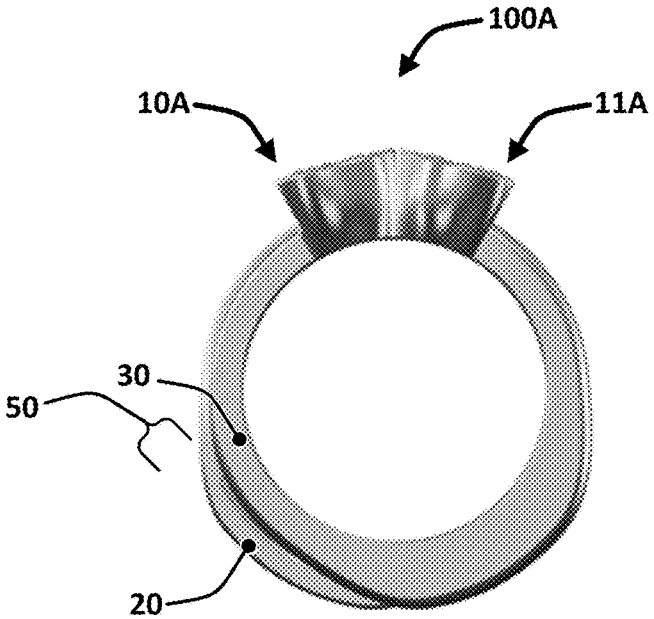
FIG. 3D illustrates a rear view of an exemplary first transformational accessory combination according to a first embodiment.

Referring to FIGS. 3A-D, an exemplary transformational accessory 100A may be illustrated. FIG. 3A illustrates an exemplary transformational accessory 100A in a first configuration, wherein a first half structure 10A is abutted against a second half structure 11A to form a full symbol, which as illustratively provided is a heart with an asymptotic hole near its center. According to this exemplary embodiment, symbol half 10A may be coupled to a slotted shank 20 while symbol half 11A is coupled to posted shank 30, via a post 40 having a stem 41 and head 42. An exemplary posted shank 30 may have an arch trench 31, which may be a recessed portion of the slide-contact surface of posted shank 30 that substantially overlaps with arch slot 21 of slotted shank 20. As will be further described with respect to FIG. 5, the exemplary transformational accessory 100A may transform or convert to a different symbol comprised of the same halves 10A and 11A, but according to a different configuration, which as illustrated in FIG. 3B may be a butterfly. FIG. 3C may illustrate the engagement between shanks 20 and 30 via the slot 21 of shank 20 and the post 40 components, including head 42. As may be illustrated via FIG. 3D, an exemplary shank 20 and shank 30 may be in sliding contact with one another throughout the transformational process between exemplary transformational accessory 100A conversions, but may nevertheless result in an offset surface 50 therebetween. In an exemplary embodiment, the offset distance may be any distance that correlates to the arc of the slot 21 in shank 20 through which the post 40 of shank 30 may be meant to travel to accomplish the conversion between symbol halves 10A and 11A. In an exemplary embodiment, the offset 50 of an exemplary transformational accessory 100A may be a radial distance from the common center of shanks 20/30 that is between 5% and 15% greater than the radial distance to the symbol halves 10A/11A. Alternatively, the offset 50 of an exemplary shank 20/30 may be equivalent to the amount of area necessitated to accommodate the placement of an exemplary arched slot 21.

Figure 3E:
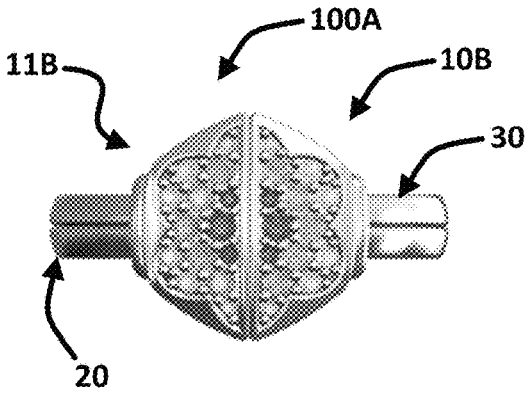
FIG. 3E illustrates a top view of an exemplary first transformational accessory combination according to a second embodiment.
Figure 3F:
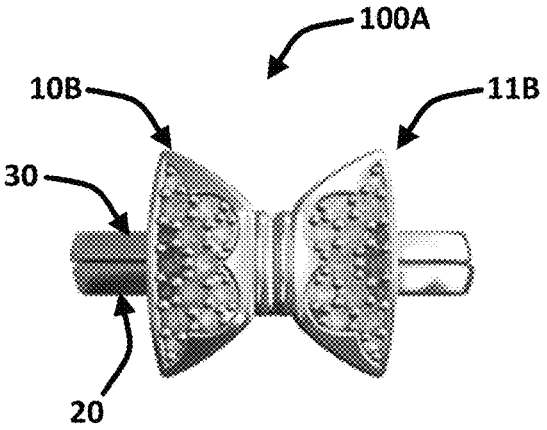
FIG. 3F illustrates a top view of an exemplary second transformational accessory combination according to a second embodiment.
Figure 3G:
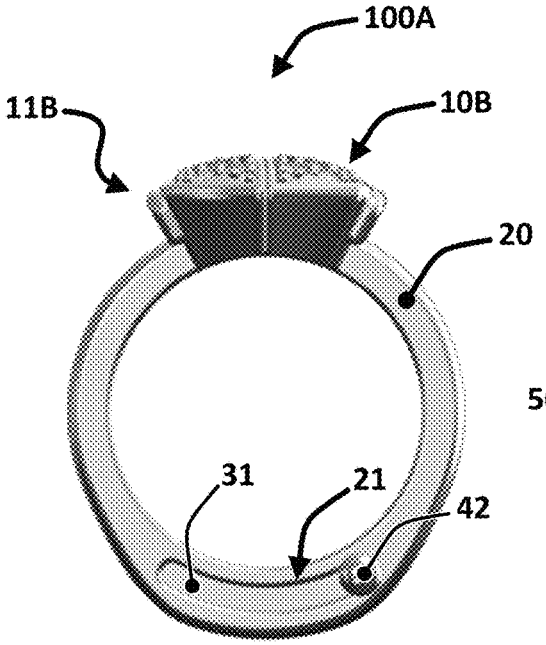
FIG. 3G illustrates a front view of an exemplary first transformational accessory combination according to a second embodiment.
Figure 3H:
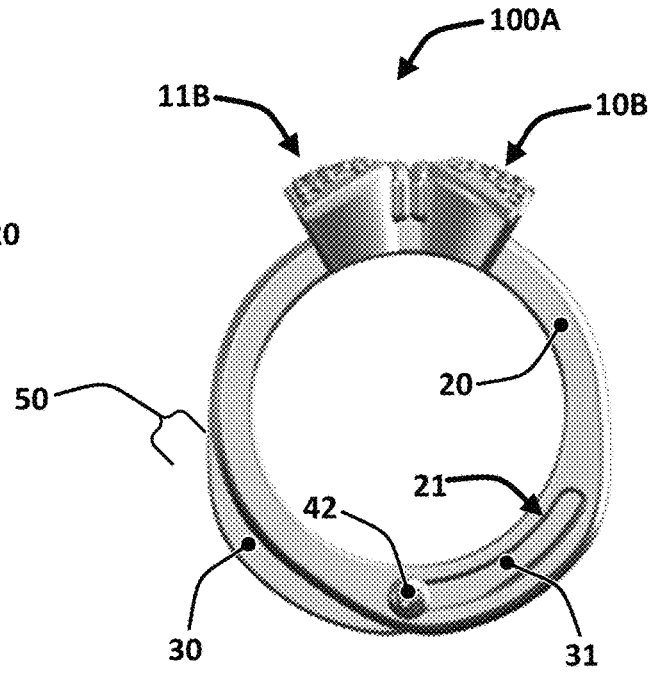
FIG. 3H illustrates a front view of an exemplary second transformational accessory combination according to a second embodiment.

Referring to FIGS. 3E-H, an exemplary transformational accessory 100B may be illustrated. FIG. 3E illustrates an exemplary transformational accessory 100B in a first configuration, wherein a first half structure 10B is abutted against a second half structure 11B to form a full symbol, which as illustratively provided may be a diamond-like shape. According to this exemplary embodiment, symbol half 10B may be coupled to a slotted shank 20 while symbol half 11B is coupled to posted shank 30, via a post 40 having a stem 41 and head 42. An exemplary posted shank 30 may have an arch trench 31, which may be a recessed portion of the slide-contact surface of posted shank 30 that substantially overlaps with arch slot 21 of slotted shank 20. As will be further described with respect to FIG. 6, the exemplary transformational accessory 100B may transform or convert to a different symbol comprised of the same halves 10B and 11B, but according to a different configuration, which as illustrated in FIG. 3B may be a bowtie-like structure. FIG. 3C may illustrate the engagement between shanks 20 and 30 via the slot 21 of shank 20 and the post 40 components, including head 42. As may be illustrated via FIG. 3D, an exemplary shank 20 and shank 30 may be in sliding contact with one another throughout the transformational process between exemplary transformational accessory 100B conversions but may nevertheless result in an offset surface 50 therebetween. In an exemplary embodiment, the offset distance may be any distance that correlates to the arc of the slot 21 in shank 20 through which the post 40 of shank 30 may be meant to travel to accomplish the conversion between symbol halves 10B and 11B. In an exemplary embodiment, the offset 50 of an exemplary transformational accessory 100A may be a radial distance from the common center of shanks 20/30 that is between 5% and 15% greater than the radial distance to the symbol halves 10B/11B. Alternatively, the offset 50 of an exemplary shank 20/30 may be equivalent to the amount of area necessitated to accommodate the placement of an exemplary arched slot 21.

Figure 3I:
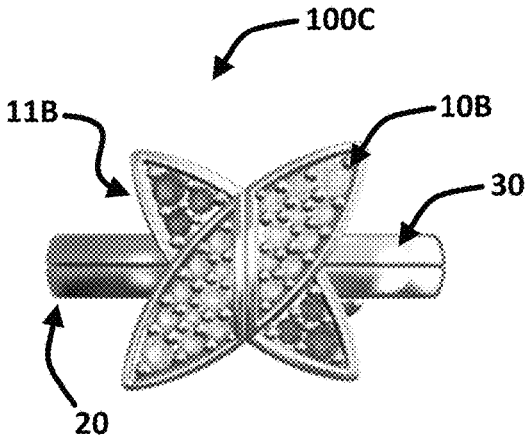
FIG. 3I illustrates a top view of an exemplary first transformational accessory combination according to a third embodiment.
Figure 3J:
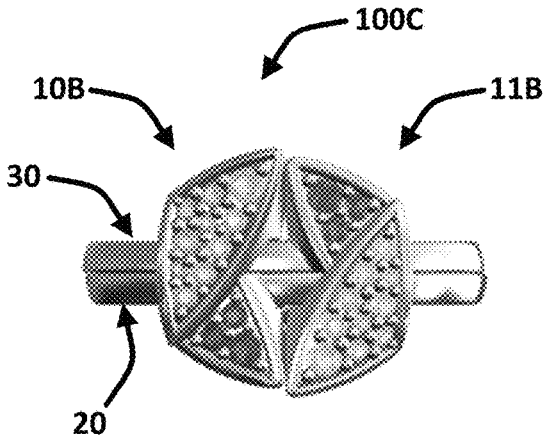
FIG. 3J illustrates a top view of an exemplary second transformational accessory combination according to a third embodiment.
Figure 3K:
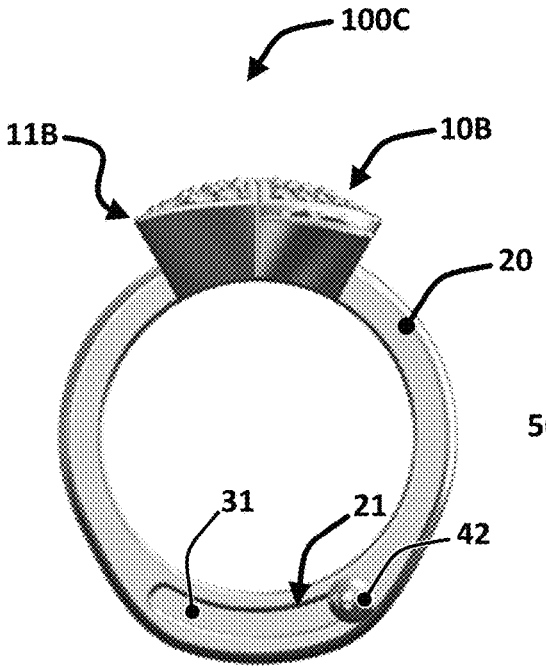
FIG. 3K illustrates a front view of an exemplary first transformational accessory combination according to a third embodiment.
Figure 3L:
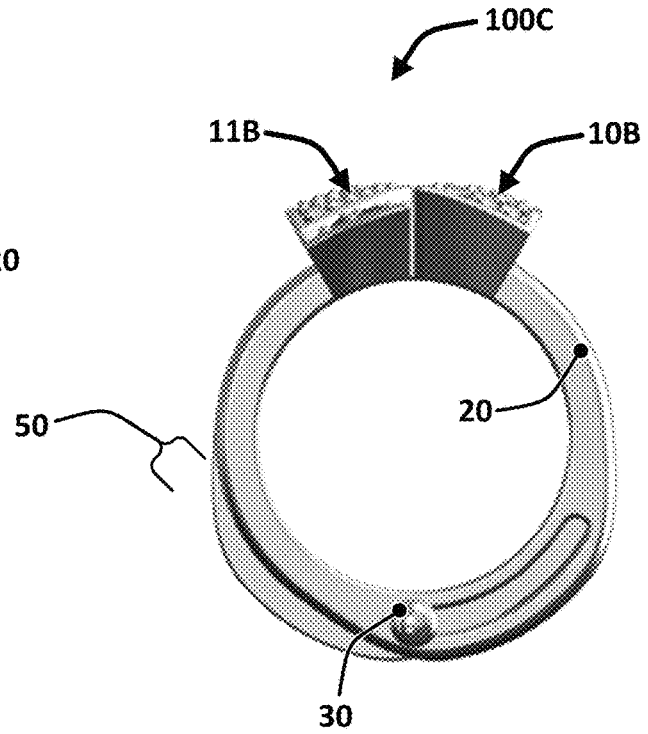
FIG. 3L illustrates a rear view of an exemplary first transformational accessory combination according to a third embodiment.

Referring to FIGS. 3I-L, an exemplary transformational accessory 100C may be illustrated. FIG. 3I illustrates an exemplary transformational accessory 100C in a first configuration, wherein a first half structure 10C is abutted against a second half structure 11C to form a full symbol, which as illustratively provided may be a star-like shape. According to this exemplary embodiment, symbol half 10C may be coupled to a slotted shank 20 while symbol half 11C is coupled to posted shank 30, via a post 40 having a stem 41 and head 42. An exemplary posted shank 30 may have an arch trench 31, which may be a recessed portion of the slide-contact surface of posted shank 30 that substantially overlaps with arch slot 21 of slotted shank 20. As will be further described with respect to FIG. 7, the exemplary transformational accessory 100C may transform or convert to a different symbol comprised of the same halves 10C and 11C, but according to a different configuration, which as illustrated in FIG. 3J may be a hexagonal structure with an asymptotic diamond hole around the shape center. FIG. 3K may illustrate the engagement between shanks 20 and 30 via the slot 21 of shank 20 and the post 40 components, including head 42. As may be illustrated via FIG. 3L, an exemplary shank 20 and shank 30 may be in sliding contact with one another throughout the transformational process between exemplary transformational accessory 100C conversions but may nevertheless result in an offset surface 50 therebetween. In an exemplary embodiment, the offset distance may be any distance that correlates to the arc of the slot 21 in shank 20 through which the post 40 of shank 30 may be meant to travel to accomplish the conversion between symbol halves 10C and 11C. In an exemplary embodiment, the offset 50 of an exemplary transformational accessory 100A may be a radial distance from the common center of shanks 20/30 that is between 5% and 15% greater than the radial distance to the symbol halves 10C/11C. Alternatively, the offset 50 of an exemplary shank 20/30 may be equivalent to the amount of area necessitated to accommodate the placement of an exemplary arched slot 21.

Figure 4A:
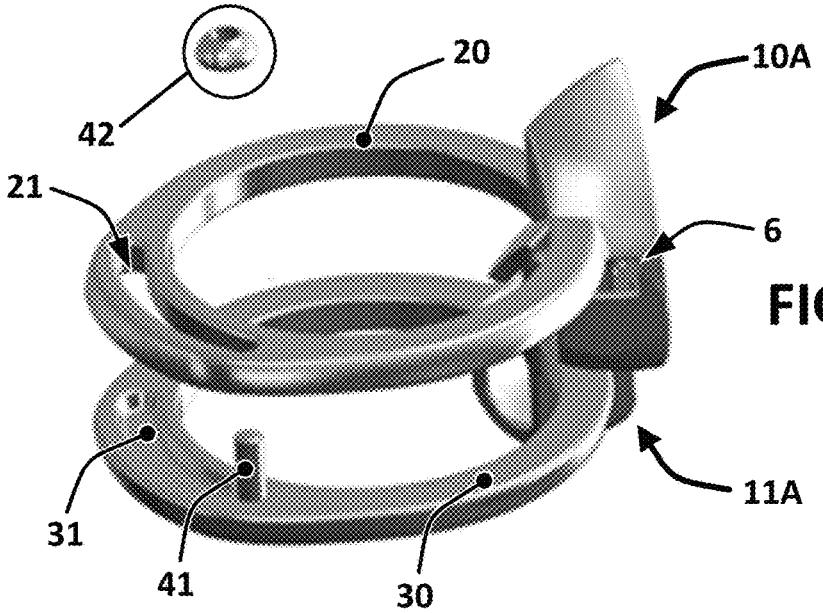
FIG. 4A illustrates an exploded view of an exemplary transformational accessory combination according to one or more of the embodiments described herein.
Figure 4B:
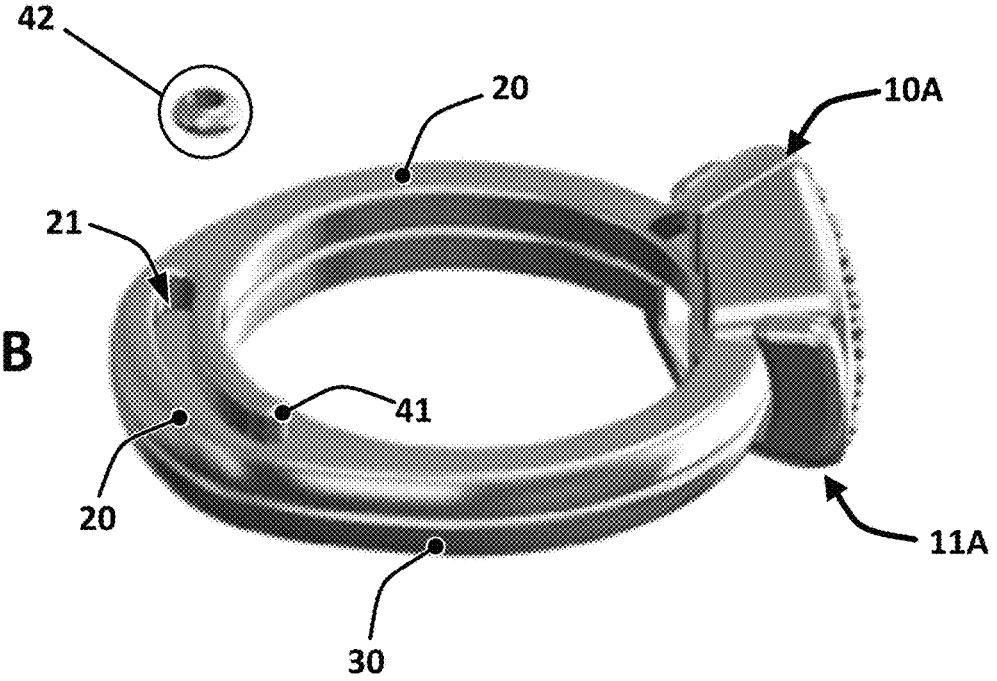
FIG. 4B illustrates a partially-exploded view of an exemplary transformational accessory combination according to one or more of the embodiments described herein.

Referring to FIGS. 4A and 4B, an exemplary transformational accessory may be shown in exploded and nearly-fully assembled configurations, respectively. As illustrated in the illustrative embodiment depicted in FIG. 4A, an exemplary transformational accessory may be formed from a combination of a first half structure 10A coupled to a slotted shank 20 having therein a slot 21. The half structure 10A has a cavity 6 through its thickness to allow for passage of the posted shank 30, from which a post 41 extends outwardly away from the majority of the second half structure 11A coupled thereto. As illustratively provided for in FIG. 4B, an assembled transformational accessory may have the slot 21 of the exemplary slotted shank 20 substantially overlap a recessed trench portion 31 formed in an exemplary posted shank 30. Alternatively, no recessed portion 31 may be present in the posted shank 30 according to other embodiments. In an exemplary assembled configuration, an exemplary transformational accessory may have the post 41 of an exemplary posted shank 30 protrude through the slot 21 of exemplary slotted shank 20 to be held therein and translate along the path of the slot 21, which has been illustrated as an arch-like shape, but may be any others depending on needs. A head 42 may be assembled to post 41 to couple the two shanks 20 and 30 to one another as a fully assembled transformational accessory 100A. An exemplary head 42 may be soldered, welded, adhesively adhered, screwed onto, or otherwise mechanically or chemically affixed to post 41 to effectuate the formation of an exemplary transformational accessory 100A using known techniques to those skilled in the art, including the jewelry making arts.

Figure 1X:
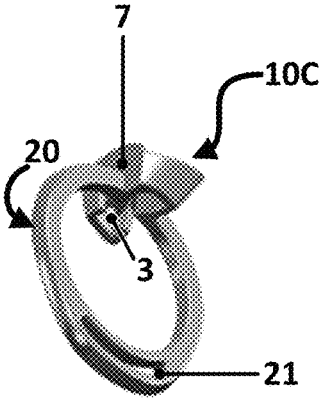
FIG. 1X illustrates a bottom view of an exemplary first transformational accessory component according to a third embodiment.

Reference is now made to FIGS. 1A-X. An exemplary first transformational accessory component may have a half structure 10A with a slotted shank 20 coupled thereto. The half structure 10A may have a plurality of surfaces and sections to enable the transformations and conversions disclosed in FIGS. 5-7. In an exemplary embodiment, half structure 10A may have a shank coupling region or junction 2 that may be an integrated, adhered, friction fit, or otherwise mechanically or chemically induced coupling between the shank 20 and half structure 10A. An exemplary half structure 10A may have two a structure abutment faces: a first abutment face 7 and a second abutment face 9, each of which being a face of the half structure 10A that may eventually abut the opposing first or second abutment face of half structure 11A during transformation/conversion of the assembled transformational accessory 100A. The abutment face 7 may be divided by the shank 20 and a bridge 5 that separates the half structure 10A into two sections: a base section 4 and an extender section 8. An exemplary extender section 8 may comprise an abutment face 7 coupled to the remainder of the half structure 10A via a bridge 5 that spans a channel 6 through the half structure 10A. The body 3 of an exemplary half structure 10A may be solid or hollow, depending on needs, but may be largely obscured from view when the transformational accessory 100A is assembled and in use. As illustratively provided for in FIGS. 1A-H, an exemplary first embodiment may provide for a component comprised of an exemplary half structure 10A and a slotted shank 20 that may be combined with one or more of the posted shank 30 and half structures 11A-C provided in FIGS. 2A-X.

An exemplary second transformational accessory component may have a half structure 10B with a slotted shank 20 coupled thereto. The half structure 10B may have a plurality of surfaces and sections to enable the transformations and conversions disclosed in FIGS. 5-7. In an exemplary embodiment, half structure 10B may have a shank coupling region or junction 2 that may be an integrated, adhered, friction fit, or otherwise mechanically or chemically induced coupling between the shank 20 and half structure 10B. An exemplary half structure 10B may have two a structure abutment faces: a first abutment face 7 and a second abutment face 9, each of which being a face of the half structure 10B that may eventually abut the opposing first or second abutment face of half structure 11B during transformation/conversion of the assembled transformational accessory 100B. The abutment face 7 may be divided by the shank 20 and a bridge 5 that separates the half structure 10B into two sections: a base section 4 and an extender section 8. An exemplary extender section 8 may comprise an abutment face 7 coupled to the remainder of the half structure 10B via a bridge 5 that spans a channel 6 through the half structure 10B. The body 3 of an exemplary half structure 10B may be solid or hollow, depending on needs, but may be largely obscured from view when the transformational accessory 100B is assembled and in use. As illustratively provided for in FIGS. 1I-P, an exemplary first embodiment may provide for a component comprised of an exemplary half structure 10B and a slotted shank 20 that may be combined with one or more of the posted shank 30 and half structures 11B-C provided in FIGS. 2A-X.

An exemplary third transformational accessory component may have a half structure 10C with a slotted shank 20 coupled thereto. The half structure 10C may have a plurality of surfaces and sections to enable the transformations and conversions disclosed in FIGS. 5-7. In an exemplary embodiment, half structure 10C may have a shank coupling region or junction 2 that may be an integrated, adhered, friction fit, or otherwise mechanically or chemically induced coupling between the shank 20 and half structure 10C. An exemplary half structure 10C may have two a structure abutment faces: a first abutment face 7 and a second abutment face 9, each of which being a face of the half structure 10C that may eventually abut the opposing first or second abutment face of half structure 11C during transformation/conversion of the assembled transformational accessory 100C. The abutment face 7 may be divided by the shank 20 and a bridge 5 that separates the half structure 10C into two sections: a base section 4 and an extender section 8. An exemplary extender section 8 may comprise an abutment face 7 coupled to the remainder of the half structure 10C via a bridge 5 that spans a channel 6 through the half structure 10C. The body 3 of an exemplary half structure 10C may be solid or hollow, depending on needs, but may be largely obscured from view when the transformational accessory 100C is assembled and in use. As illustratively provided for in FIGS. 1Q-X, an exemplary first embodiment may provide for a component comprised of an exemplary half structure 10C and a slotted shank 20 that may be combined with one or more of the posted shank 30 and half structures 11C-C provided in FIGS. 2A-X.

Figure 2A:
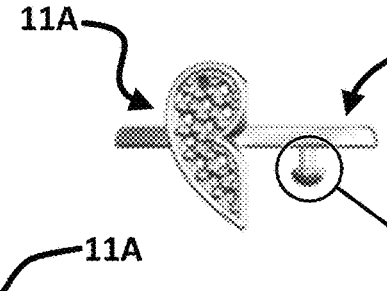
FIG. 2A illustrates a top view of an exemplary second transformational accessory component according to a first embodiment.
Figure 2B:
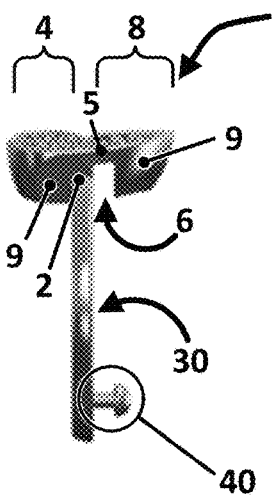
FIG. 2B illustrates a profile view of the external face of an exemplary second transformational accessory component according to a first embodiment.
Figure 2C:
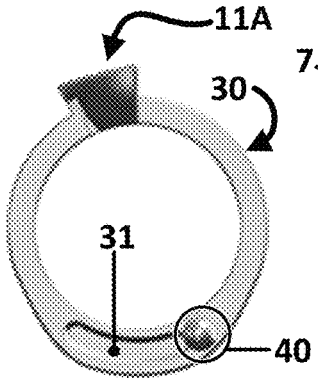
FIG. 2C illustrates a front view of an exemplary second transformational accessory component according to a first embodiment.
Figure 2D:
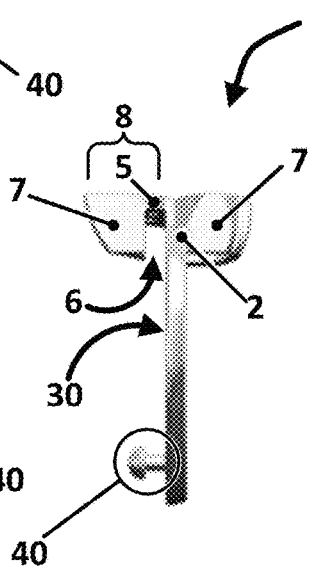
FIG. 2D illustrates a profile view of the external face of an exemplary second transformational accessory component according to a first embodiment.
Figure 2E:
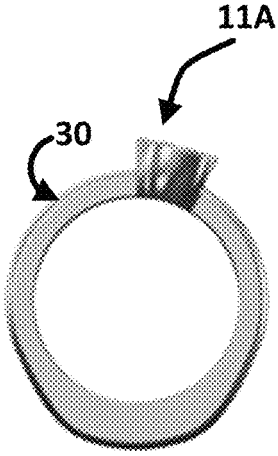
FIG. 2E illustrates a rear view of an exemplary second transformational accessory component according to a first embodiment.
Figure 2F:
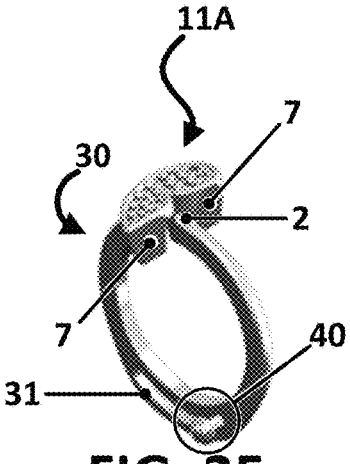
FIG. 2F illustrates an isometric view of the external face of an exemplary second transformational accessory component according to a first embodiment.
Figure 2G:
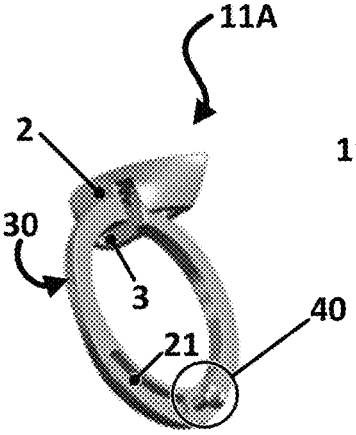
FIG. 2G illustrates an isometric view of the internal face of an exemplary second transformational accessory component according to a first embodiment.
Figure 2H:
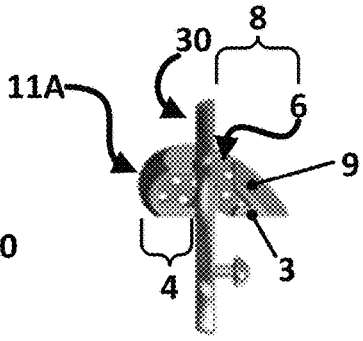
FIG. 2H illustrates a bottom view of an exemplary second transformational accessory component according to a first embodiment.
Figure 2I:
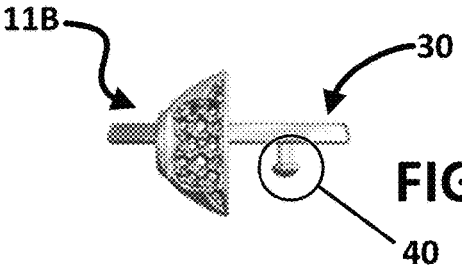
FIG. 2I illustrates a top view of an exemplary second transformational accessory component according to a second embodiment.
Figure 2J:
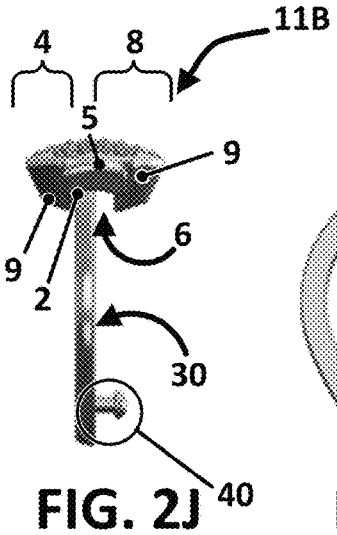
FIG. 2J illustrates a profile view of the external face of an exemplary second transformational accessory component according to a second embodiment.
Figure 2K:
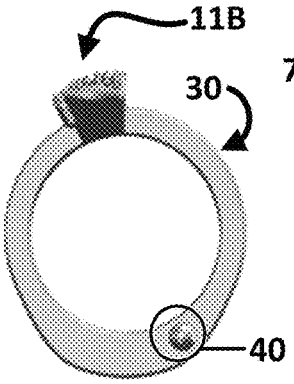
FIG. 2K illustrates a front view of an exemplary second transformational accessory component according to a second embodiment.
Figure 2L:
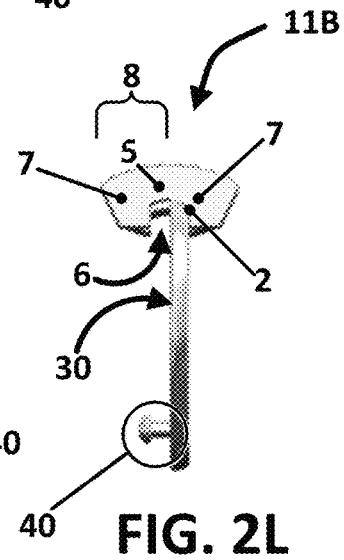
FIG. 2L illustrates a profile view of the external face of an exemplary second transformational accessory component according to a second embodiment.
Figure 2M:
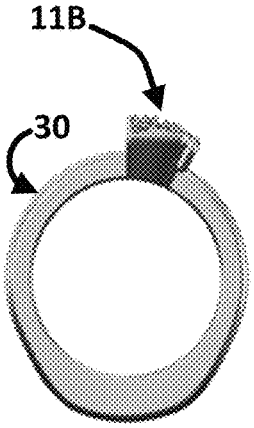
FIG. 2M illustrates a rear view of an exemplary second transformational accessory component according to a second embodiment.
Figure 2N:
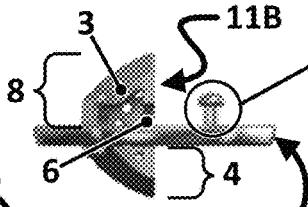
FIG. 2N illustrates an isometric view of the external face of an exemplary second transformational accessory component according to a second embodiment.
Figure 2O:
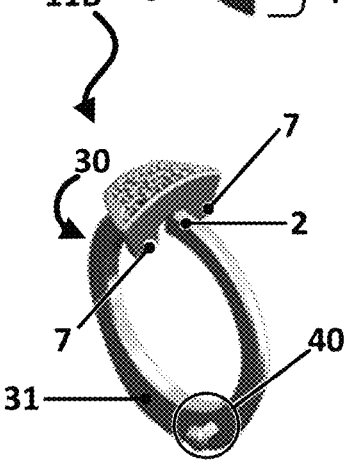
FIG. 2O illustrates an isometric view of the internal face of an exemplary second transformational accessory component according to a second embodiment.
Figure 2P:
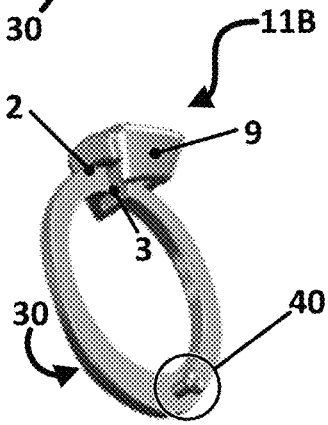
FIG. 2P illustrates a bottom view of an exemplary second transformational accessory component according to a second embodiment.
Figure 2Q:
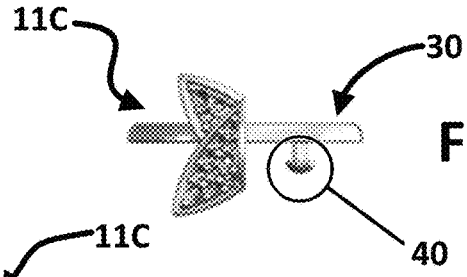
FIG. 2Q illustrates a top view of an exemplary second transformational accessory component according to a third embodiment.
Figure 2R:
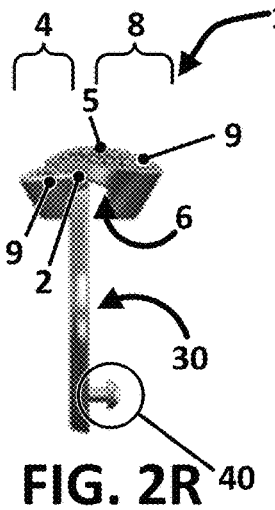
FIG. 2R illustrates a profile view of the external face of an exemplary second transformational accessory component according to a third embodiment.
Figure 2S:
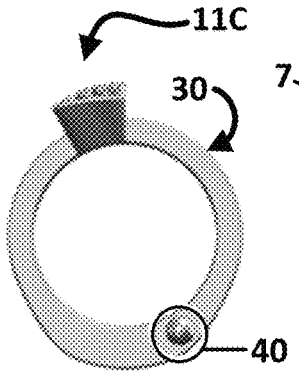
FIG. 2S illustrates a front view of an exemplary second transformational accessory component according to a third embodiment.
Figure 2T:
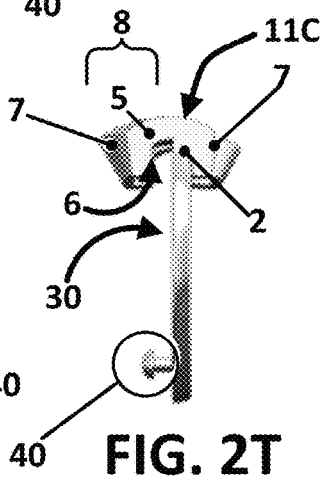
FIG. 2T illustrates a profile view of the external face of an exemplary second transformational accessory component according to a third embodiment.
Figure 2U:
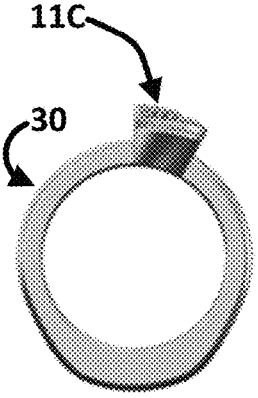
FIG. 2U illustrates a rear view of an exemplary second transformational accessory component according to a third embodiment.
Figure 2V:
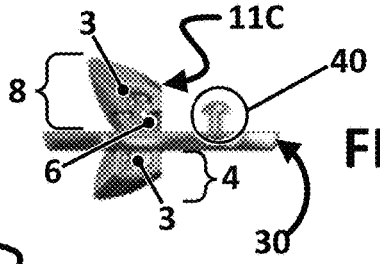
FIG. 2V illustrates an isometric view of the external face of an exemplary second transformational accessory component according to a third embodiment.
Figure 2W:
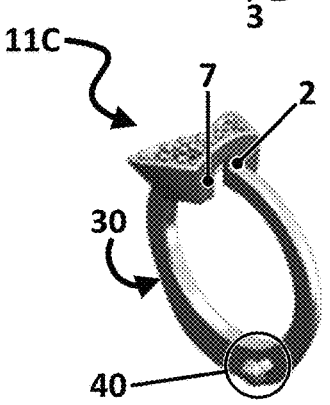
FIG. 2W illustrates an isometric view of the internal face of an exemplary second transformational accessory component according to a third embodiment.
Figure 2X:
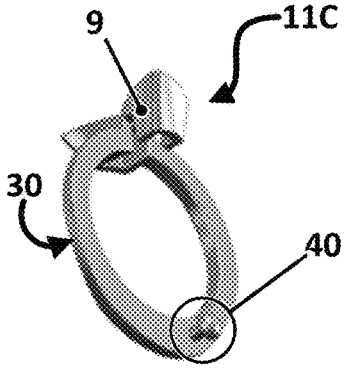
FIG. 2X illustrates a bottom view of an exemplary second transformational accessory component according to a third embodiment.

Reference is now made to FIGS. 2A-X. An exemplary first transformational accessory component may have another half structure 11A with a posted shank 30 coupled thereto. The half structure 11A may have a plurality of surfaces and sections to enable the transformations and conversions disclosed in FIGS. 5-7. In an exemplary embodiment, half structure 11A may have a shank coupling region or junction 2 that may be an integrated, adhered, friction fit, or otherwise mechanically or chemically induced coupling between the shank 30 and half structure 11A. An exemplary posted shank 30 may have an optional recessed section 31 adjacent to or from which a post 40 may extend. An exemplary half structure 11A may have two a structure abutment faces: a first abutment face 7 and a second abutment face 9, each of which being a face of the half structure 11A that may eventually abut the opposing first or second abutment face of half structure 10A during transformation/conversion of the assembled transformational accessory 100A. The abutment face 7 may be divided by the shank 30 and a bridge 5 that separates the half structure 11A into two sections: a base section 4 and an extender section 8. An exemplary extender section 8 may comprise an abutment face 7 coupled to the remainder of the half structure 11A via a bridge 5 that spans a channel 6 through the half structure 11A. The body 3 of an exemplary half structure 11A may be solid or hollow, depending on needs, but may be largely obscured from view when the transformational accessory 100A is assembled and in use. As illustratively provided for in FIGS. 2A-H, an exemplary first embodiment may provide for a component comprised of an exemplary half structure 11A and a posted shank 30 that may be combined with one or more of the slotted shank 20 and half structures 10A-C provided in FIGS. 1A-X.

An exemplary second transformational accessory component may have another half structure 11B with a posted shank 30 coupled thereto. The half structure 11B may have a plurality of surfaces and sections to enable the transformations and conversions disclosed in FIGS. 5-7. In an exemplary embodiment, half structure 11B may have a shank coupling region or junction 2 that may be an integrated, adhered, friction fit, or otherwise mechanically or chemically induced coupling between the shank 30 and half structure 11B. An exemplary posted shank 30 may have an optional recessed section 31 adjacent to or from which a post 40 may extend. An exemplary half structure 11B may have two a structure abutment faces: a first abutment face 7 and a second abutment face 9, each of which being a face of the half structure 11B that may eventually abut the opposing first or second abutment face of half structure 10B during transformation/conversion of the assembled transformational accessory 100B. The abutment face 7 may be divided by the shank 30 and a bridge 5 that separates the half structure 11B into two sections: a base section 4 and an extender section 8. An exemplary extender section 8 may comprise an abutment face 7 coupled to the remainder of the half structure 11B via a bridge 5 that spans a channel 6 through the half structure 11B. The body 3 of an exemplary half structure 11B may be solid or hollow, depending on needs, but may be largely obscured from view when the transformational accessory 100B is assembled and in use. As illustratively provided for in FIGS. 2I-P, an exemplary first embodiment may provide for a component comprised of an exemplary half structure 11B and a posted shank 30 that may be combined with one or more of the slotted shank 20 and half structures 10B-C provided in FIGS. 1A-X.

An exemplary third transformational accessory component may have another half structure 11C with a posted shank 30 coupled thereto. The half structure 11C may have a plurality of surfaces and sections to enable the transformations and conversions disclosed in FIGS. 5-7. In an exemplary embodiment, half structure 11C may have a shank coupling region or junction 2 that may be an integrated, adhered, friction fit, or otherwise mechanically or chemically induced coupling between the shank 30 and half structure 11C. An exemplary posted shank 30 may have an optional recessed section 31 adjacent to or from which a post 40 may extend. An exemplary half structure 11C may have two a structure abutment faces: a first abutment face 7 and a second abutment face 9, each of which being a face of the half structure 11C that may eventually abut the opposing first or second abutment face of half structure 10C during transformation/conversion of the assembled transformational accessory 100C. The abutment face 7 may be divided by the shank 30 and a bridge 5 that separates the half structure 11C into two sections: a base section 4 and an extender section 8. An exemplary extender section 8 may comprise an abutment face 7 coupled to the remainder of the half structure 11C via a bridge 5 that spans a channel 6 through the half structure 11C. The body 3 of an exemplary half structure 11C may be solid or hollow, depending on needs, but may be largely obscured from view when the transformational accessory 100C is assembled and in use. As illustratively provided for in FIGS. 2Q-X, an exemplary first embodiment may provide for a component comprised of an exemplary half structure 11C and a posted shank 30 that may be combined with one or more of the slotted shank 20 and half structures 10C-C provided in FIGS. 1A-X.

Figure 5:
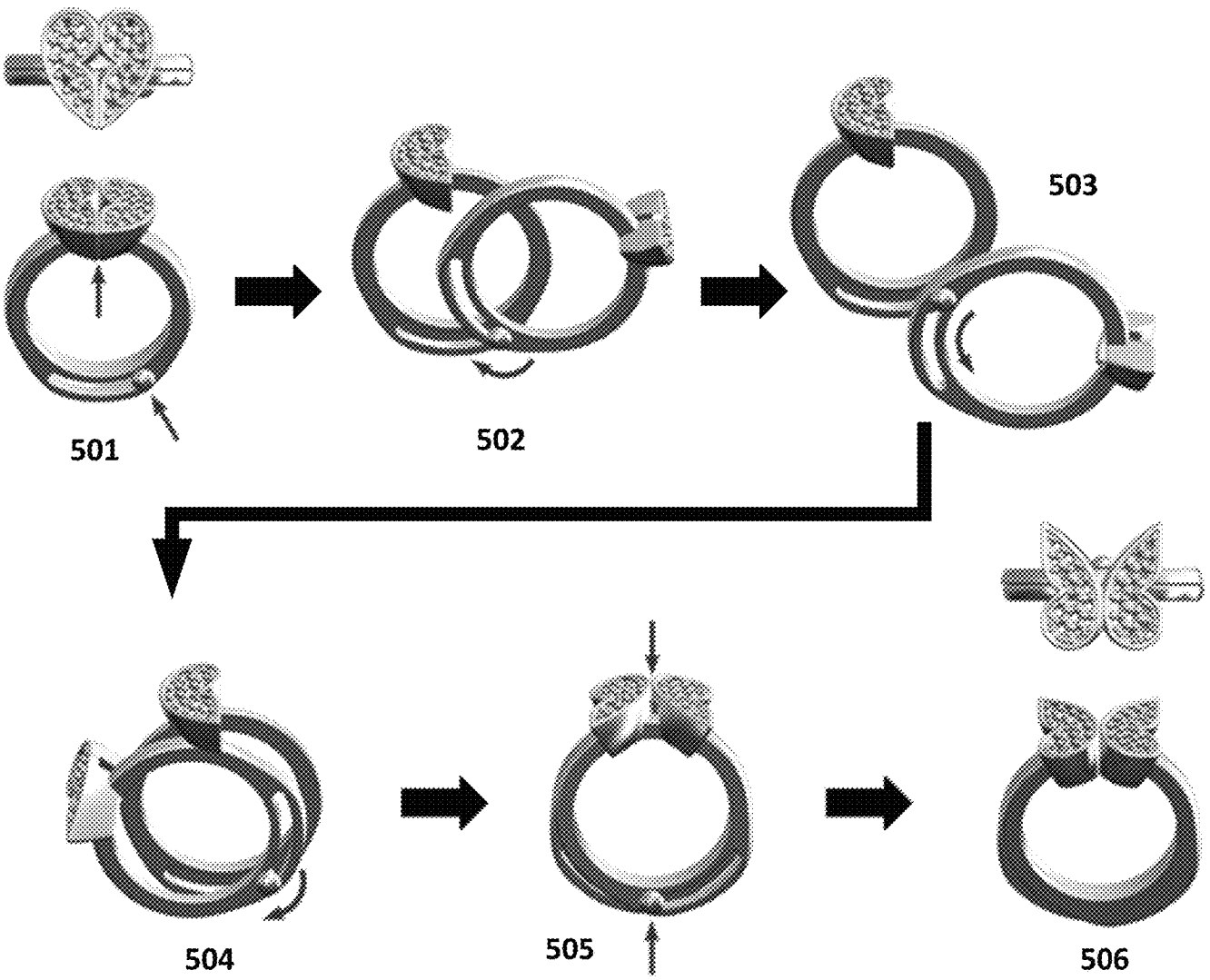
FIG. 5 illustrates an exemplary transformational method for an exemplary transformational accessory according to a first embodiment.
Figure 6:
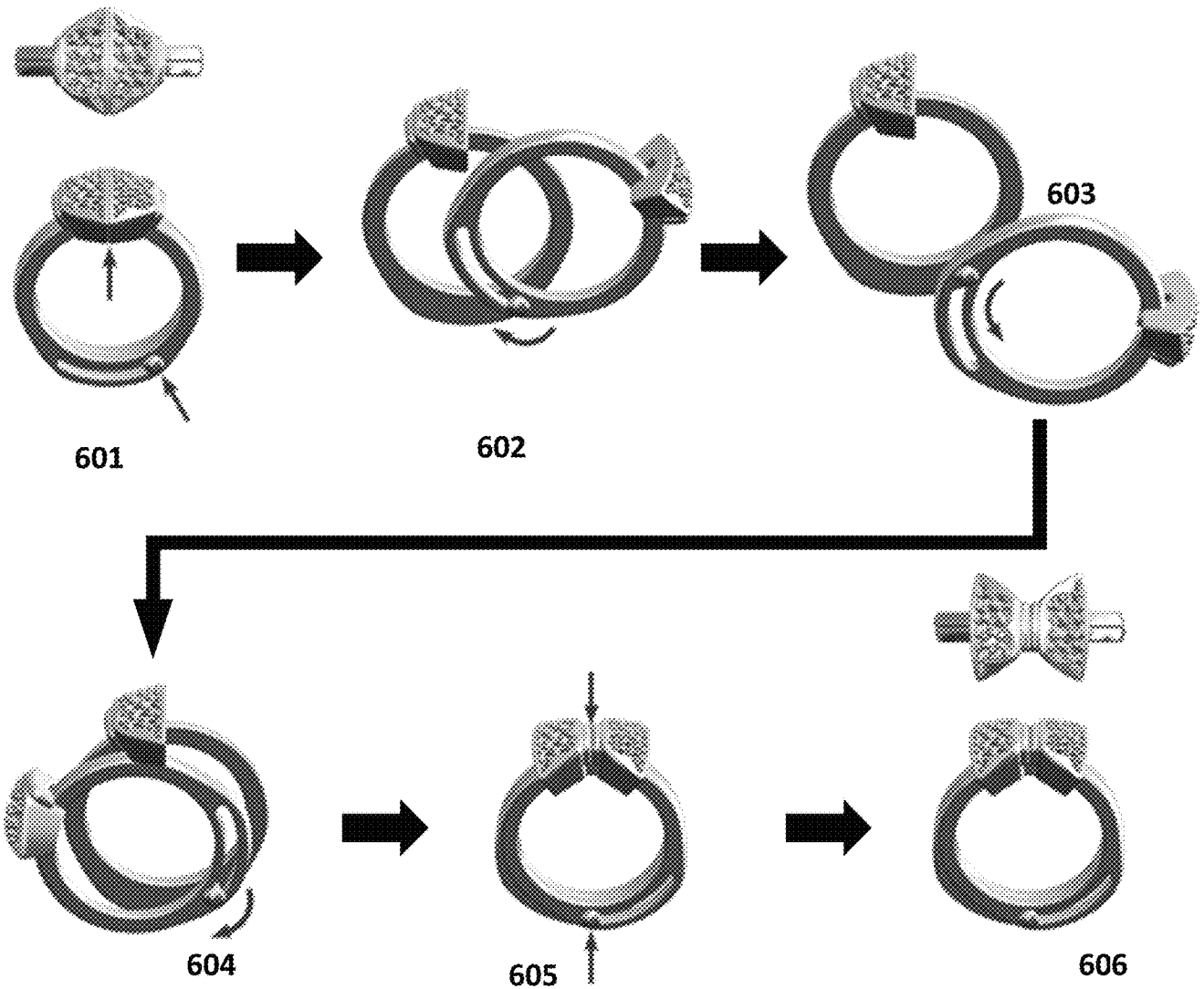
FIG. 6 illustrates an exemplary transformational method for an exemplary transformational accessory according to a second embodiment.
Figure 7:
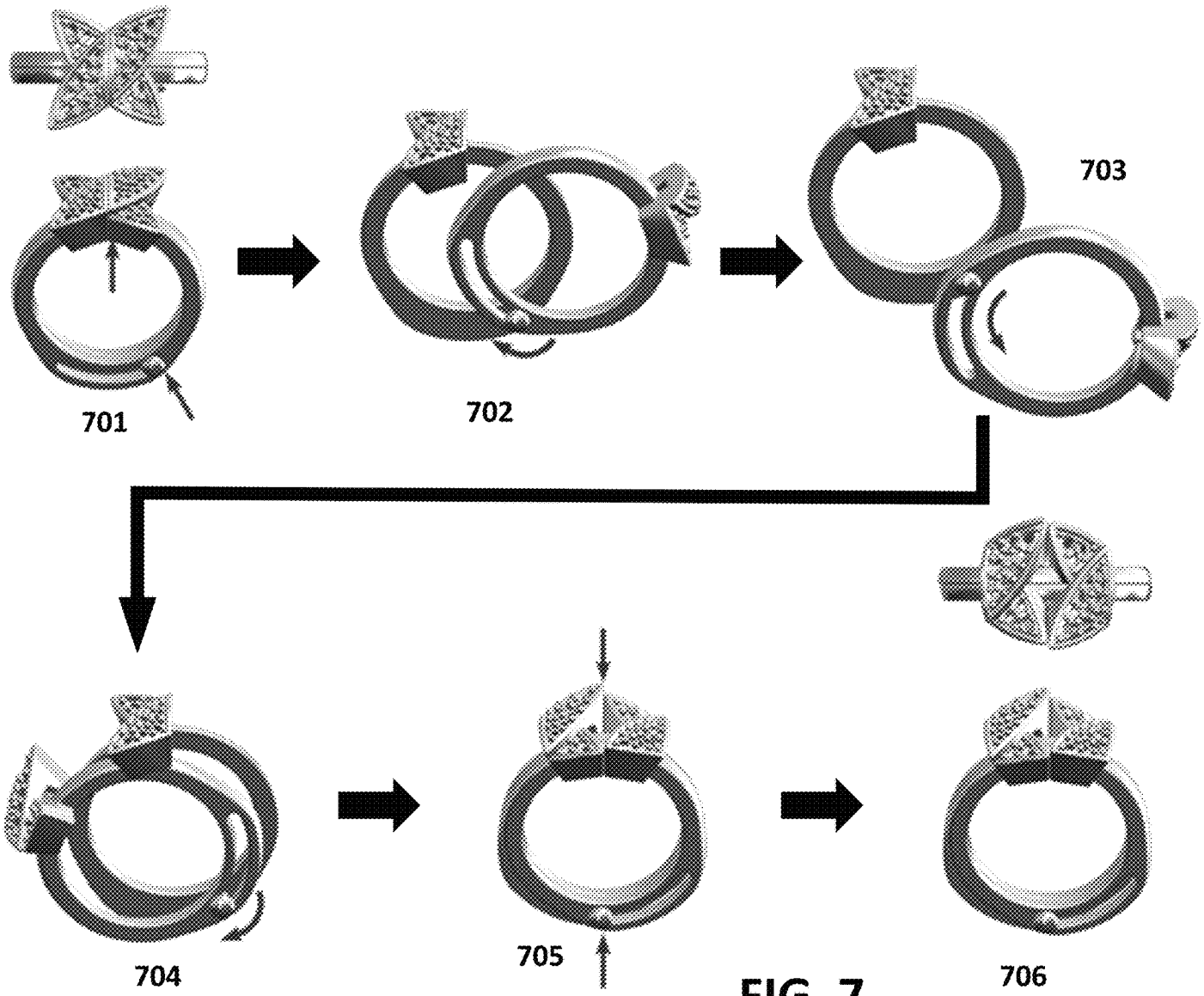
FIG. 7 illustrates an exemplary transformational method for an exemplary transformational accessory according to a third embodiment.

Referring to FIGS. 5-7, an exemplary method of transforming between configurations of an exemplary transformational accessory 100A-C may be illustrated. Each transformation illustrated may be described in similar fashion. In an exemplary assembled step 501/601/701, an exemplary transformational accessory 100A-C, respectively, may be grasped by a user and moved to the decoupling stage, 502/602/702, in which the abutment faces 7 of each half structure 10A-C and 11A-C are rotated away from one another by virtue of the translation of post 40 via slot 21 of the posted shank 30 and slotted shank 20, respectively. In an exemplary reversal stage, 503/603/703, an exemplary half structure 10A-C may be rotated about the circumference of post 40 to a rotated position that is at least 90 degrees but less than 350 degrees with respect to half structure 11A-C. In an exemplary reversal stage, an exemplary post 40 may be located at a portion of slot 21 that may be most proximal to the half structure 10A-C. In an exemplary reverse slide step 504/604/704, an exemplary slotted shank 20 may be displaced so that the post 40 of the posted shank 30 may abut a different portion of the slot 21 of the slotted shank 20, such as, for example, a portion of slot 21 most distal to the half structure 10A-C. In an exemplary abutment step 505/605/705, the abutment face 9 of each half structure 10A-C and 11A-C may come into contact while the slotted shank 21 may be frictionally engaged to the post 40 by virtue of the sliding of the material of each shank 20/30 against the other, as well as any friction-inducing surfaces in the offset areas 50 on either shank 20/30. In an exemplary transformed assembly step 506/606/706, a new transformational accessory 100A-C may achieve a new configuration. That differs from the assembly present at step 501/601/701.

While the illustrated and described configurations resemble one or more shapes, the skilled artisan may develop multitude other configurations that may be had via use of the disclosed jewelry transformation mechanisms.

In all exemplary embodiments, any disclosed component may be made of any metal and molded using known methods, e.g., lost wax casting processes, additive manufacturing (i.e., 3D printing), or print-to-cast methodologies. Additionally, exemplary stem 41 of an exemplary post 40 may be comprised of metal wire or cylinders, and in a preferred embodiment be 1.0 mm gold wire, and head 42 may be of similar material that is adhered to an exemplary stem 41 via welding (e.g., vibration welding and/or laser welding) or mechanical attachments (e.g., screwed into corresponding threaded holes on stem 41). Alternatively, any metal of any disclosed component may be polished and/or surface cleaned before assembly/molding the same to the final transformational accessory 100A-C. Further alternatively, any portion of the transformational accessory 100A-C, but preferably the half structures 10A-C/11A-C may be adorned with any known ornamentation in the jewelry arts. Additionally, it may be contemplated that when half structures 10A-C/11A-C abut one another about one or more faces 7/9, an internal circuit may be triggered to light up a portion of one or both half structures 10A-C/11A-C.

Many further variations and modifications may suggest themselves to those skilled in art upon making reference to above disclosure and foregoing interrelated and interchangeable illustrative embodiments, which are given by way of example only, and are not intended to limit the scope and spirit of the interrelated embodiments of the invention described herein.

The invention claimed is:

1. A transformable accessory, comprising:

a first half structure having a first abutment surface, the first half structure being coupled to a slotted shank with a slot therein;

a second half structure having a second abutment surface, the second half structure being coupled to a posted shank with a post extending therefrom, wherein the post of the posted shank is received within the slot of the slotted shank; and a configuration in which the first abutment surface and the second abutment surface are circumferentially separated from one another, wherein the slotted shank comprises a sidewall and the slot is disposed in the sidewall of the slotted shank.

2. The transformable accessory of claim 1, further comprising an offset area adjacent one of the slot or the post.

3. The transformable accessory of claim 1, further comprising a recessed area on the posted shank that is adjacent the post.

4. A transformable accessory, comprising:

a first half structure having a first abutment surface, the first half structure being coupled to a slotted shank with a slot therein;

a second half structure having a second abutment surface, the second half structure being coupled to a posted shank with a post extending therefrom, wherein the post of the posted shank is received within the slot of the slotted shank; and a configuration in which the first abutment surface and the second abutment surface contact each other and create an asymptotic hole or form a heart, a butterfly-like structure, a bowtie-like structure, or a star-like structure wherein the slotted shank has a total thickness defined between a first side and an opposite second side, the posted shank has a total thickness defined between a first side and an opposite second side, and the opposite second side of the slotted shank faces the first side of the posted shank and directly contacts or engages the first side of the posted shank.

5. The transformable accessory of claim 4, further comprising an offset area adjacent one of the slot or the post.

6. The transformable accessory of claim 4, further comprising a recessed area on the posted shank that is adjacent to the post.

* * * * *